US010137718B2

(12) United States Patent
Hunkeler et al.

(10) Patent No.: US 10,137,718 B2
(45) Date of Patent: Nov. 27, 2018

(54) METHOD FOR PRODUCING PRINTED PRODUCTS WITH INTEGRATED COVER

(71) Applicant: HUNKELER AG, Wikon (CH)

(72) Inventors: Franz Hunkeler, Zofingen (CH); Kurt Graber, Brittnau (CH); Christian Schär, Oftringen (CH)

(73) Assignee: HUNKELER AG, Wikon (CH)

( * ) Notice: Subject to any disclaimer, the term of this patent is extended or adjusted under 35 U.S.C. 154(b) by 0 days.

(21) Appl. No.: 15/586,753

(22) Filed: May 4, 2017

(65) Prior Publication Data

US 2017/0341453 A1 Nov. 30, 2017

(30) Foreign Application Priority Data

May 30, 2016 (EP) ..... 16172048

(51) Int. Cl.
*B42C 9/00* (2006.01)
*B42C 19/02* (2006.01)
(Continued)

(52) U.S. Cl.
CPC ..... *B42C 19/02* (2013.01); *B41J 11/70* (2013.01); *B42C 1/12* (2013.01); *B42C 9/0012* (2013.01); *B42C 9/0056* (2013.01); *B42C 9/0081* (2013.01); *B42C 11/02* (2013.01); *B42C 11/04* (2013.01); *B42C 19/04* (2013.01); *B65H 35/0013* (2013.01)

(58) Field of Classification Search
CPC . G09F 3/205; G09F 3/18; G09F 3/202; G09F 3/0295; G09F 3/0323; B42C 11/04; B42C 19/02; B42C 9/0006; B42C 5/00
USPC ..... 40/316
See application file for complete search history.

(56) References Cited

U.S. PATENT DOCUMENTS 4,565,477 A * 1/1986 Axelrod ..... B42C 11/04 281/21.1
4,656,767 A * 4/1987 Tarrant ..... G09F 3/04 174/112

(Continued)

FOREIGN PATENT DOCUMENTS

EP 2159070 A1 3/2010
WO 2013/067650 A1 5/2013

OTHER PUBLICATIONS

Nov. 4, 2016 Extended Search Report issued in European Patent Application No. 16172048.7.

*Primary Examiner* — Shin H Kim
(74) *Attorney, Agent, or Firm* — Oliff PLC

(57) ABSTRACT

The invention is directed to a method for producing printed products, in particular softcover books, with integrated cover, where method includes at least the steps: printing of paper web or individually supplied paper sheets, preferably by means of digital printing; single or multiple folding and cutting of paper web to form signatures or else single or multiple folding of paper sheets to form signatures; stacking of signatures to form signature stack with at least one top and one bottom signature; folding open top sheet of top signature or else bottom sheet of bottom signature and applying an adhesive layer in at least area of folded-open sheet, which is intended to include at least spine and/or an area of signature stack adjacent to spine; and turning over sheet folded open and provided with adhesive layer around spine of signature stack, so that cover for printed product is formed.

11 Claims, 8 Drawing Sheets

(51) Int. Cl.

| | |
|---|---|
| ***B41J 11/70*** | (2006.01) |
| ***B42C 11/04*** | (2006.01) |
| ***B65H 35/00*** | (2006.01) |
| ***B42C 1/12*** | (2006.01) |
| ***B42C 11/02*** | (2006.01) |
| ***B42C 19/04*** | (2006.01) |

(56) References Cited

U.S. PATENT DOCUMENTS 5,115,586 A * 5/1992 Hawker ..... G02B 6/4482 40/316
5,580,204 A * 12/1996 Hultman ..... F16B 5/065 24/297
7,322,135 B2 * 1/2008 Gulati ..... A61B 7/02 181/131
8,516,727 B1 * 8/2013 Maraia ..... G09F 3/205 40/316
8,695,244 B2 * 4/2014 Eadie ..... A01K 11/002 119/651
9,717,888 B2 * 8/2017 Sos ..... A61M 25/09
2004/0035029 A1 * 2/2004 Forsberg ..... G09F 3/205 40/316
2004/0107610 A1 * 6/2004 Gulati ..... A61B 7/02 40/316
2005/0220532 A1 * 10/2005 Trotter ..... A47C 3/18 403/165
2006/0061083 A1 * 3/2006 Didde ..... B42C 19/06 281/21.1
2006/0182520 A1 * 8/2006 Shibuya ..... B42C 11/04 412/8
2010/0158639 A1 * 6/2010 Manico ..... B42D 1/002 412/37
2010/0313454 A1 * 12/2010 Smith, Jr. ..... G09F 3/0295 40/316
2013/0263482 A1 * 10/2013 Strater ..... G09F 3/201 40/316
2014/0259821 A1 * 9/2014 Meyerson ..... G09F 3/06 40/316
2017/0341453 A1 * 11/2017 Hunkeler ..... B42C 19/02

* cited by examiner

METHOD FOR PRODUCING PRINTED PRODUCTS WITH INTEGRATED COVER

The invention relates to a method for producing printed products, in particular softcover books, with which both the cover and the content of the printed product can be produced simultaneously in one and the same print line with one and the same printer.

Until now, primarily during the production of digitally printed booklets, in particular softcover books, use was regularly made of a method, the subject matter of which was the separate production of cover and inner part or content (i.e. usually a signature stack or paper stack, both can also be designated as a book block). The part products, produced in separate operations and often on different machines, then had to be joined together and glued in a complicated manner.

In concrete terms, according to this known method, firstly a paper web was printed and was subsequently folded and cross-cut to produce the signatures. The individual signatures were then stacked on one another in a stacking device to form a signature stack as intermediate product. In this connection, reference is made to the method described in EP 2 159 070 A1 and in WO2013/067650 A1.

In a separate process step, the covers were printed, to be specific typically in the form of printed individual sheets. In this way, a loose cover was produced as further intermediate product.

Following this, the combining of the covers and the signature stacks (or book blocks), i.e. the actual binding operation, was then carried out. Here, the signature stack or book block was firstly processed on the spine, i.e. in particular milled or roughened, and then provided with adhesive. After that, the cover was supplied and glued firmly to the signature stack (or book block).

In this context, as a rule devices which check whether the two combined part products also actually belong to each other are also needed (this is the case in particular in personalized printed products, in which a corresponding mix-up is to be ruled out, such as in the case of examination papers for students or else in the case of customer-specific bank data booklets, which nowadays are issued in particular in the private banking sector).

In a final operation, the printed product or the bound book is then trimmed on up to three sides.

The object of the present invention is therefore to provide a method by means of which an appropriate printed product can be produced overall considerably more economically and without relatively high outlay on monitoring.

According to the invention, this object is achieved by a method for producing printed products, in particular softcover books, with integrated cover, wherein the method comprises at least the following steps: (a) printing of a paper web or individually supplied paper sheets, preferably by means of digital printing; (b) optional application of an adhesive to the paper web or the paper sheets; (c) single or multiple folding and cutting of the paper web to form signatures (depending on the application, the cutting can be carried out before or after the folding) or else single or multiple folding of the paper sheets to form signatures; (d) optional application of adhesive to the signatures; (e) stacking of the signatures to form a signature stack with at least one top and one bottom signature; (f) folding open the top sheet of the top signature or else the bottom sheet of the bottom signature and applying an adhesive layer in at least the area of the folded-open sheet which is intended to comprise at least the spine and/or an area of the signature stack adjacent to the spine (i.e. in the finished printed product); (g) turning over the sheet folded open and provided with the adhesive layer around the spine of the signature stack, so that the cover for the printed product is formed; and (h) optional pressing of the cover (the pressing of the cover generally comprises the pressing of the entire printed product, in order in this way also to increase the composite stability overall).

The method according to the invention can be carried out in-line without interrupting the process chain. However, there is also the possibility that, in particular, the above steps (f), (g) and (h) are carried out off-line.

The cost advantages are obvious—as opposed to a conventional softcover printed product, the prior production of the cover, the binding operation and the regularly complicated monitoring as to whether cover and content match are dispensed with—which, in the negative case, moreover makes it necessary to stop the plant and/or to carry out post-production. According to the invention, on the other hand, cover and book spine are simultaneously labeled and printed with the content, i.e. reference is made to the content both on the front and rear side and also on the spine.

In addition, as a result of the cancelation of the physical and chronological separation during the production of cover and signature stack (or book block), the result is simplified logistic processes.

A further positive aspect of the method according to the invention consists in the fact that paper can be saved since, as compared with conventional binding operation, the milling and roughening of the paper is dispensed with. In addition, according to the method of the invention, only one grade of paper has to be used.

Furthermore, depending on the requirements and use, it is also possible to dispense with the trimming of the printed product on up to three sides.

The invention is therefore in principle used for the production of rather economical printed products which, as a rule, do not have to have a particularly long service life (e.g. including course books and otherwise "disposable" products, etc.).

In a preferred embodiment of the present invention, the adhesive is applied to the upper and/or lower side of the individual signatures before or during the stacking of the signatures. As a result of this measure, in particular the stability of the stack in itself can be improved, which is advantageous for the further processing or facilitates same.

In a further preferred embodiment of the present invention, an adhesive is applied in the spine area of the signature stack after the stacking of the signatures. Here, for example by means of suitable roller devices, the adhesive can be applied in stripes transversely or else to the entire area over the spine of the already finished signature stack (which remains held in an appropriately aligned manner). This solution is less time-consuming than the gluing of each individual signature and also supplies good stability of the stack. In addition, it imparts a certain flexibility to the back of the stack.

In a further preferred embodiment of the present invention, the adhesive layer is configured in the form of a (conventional) application of adhesive or else in the form of a double-sided adhesive tape. When a double-sided adhesive tape is used instead of adhesive, particularly high stability of the spine can be ensured. The adhesive tape can also be, for example, a prefabricated adhesive strip which, after the top or the bottom signature sheet has been turned over around the stack, is activated by means of heat. Such prefabricated adhesive strips can in principle be used for all applications of adhesive in conjunction with the method according to the invention.

In a further preferred embodiment of the present invention, the applications of adhesive are formed from cold adhesives, hot adhesives or hot melts (e.g. polyurethane adhesives) or a combination of cold and hot adhesives. In the case of the hot adhesives or hot melts, the gluing is carried out immediately as the cover sheet is turned over or by means of heat activation after the turning over.

In a further preferred embodiment of the present invention, one or more grooves are introduced into the paper web sections or paper sheets (or signature sheets) provided as the top or as the bottom signature. Such grooving serves to facilitate turning over the respective cover sheet by means of corresponding weakening of the paper. Here, the grooves are preferably arranged such that they correspond to the thickness of the printed product or softcover book. In other words, the (paper) surface between the preferably two parallel grooves forms the spine of the printed product or softcover book.

During turning over, the folded-open cover sheet is therefore preferably bent twice through about 90°—i.e. respectively along the grooves (which define corresponding turn-over lines). As a rule, the grooving is carried out before the corresponding sheet (i.e. either the sheet cut out of the paper web or the individually supplied sheet) is folded and, just like the application of adhesive, can be set dynamically and automatically with regard to the desired thickness of the printed product. Instead of grooving, a perforation or else a track of water droplets can in principle also be provided for weakening the paper.

In a further preferred embodiment of the present invention, the paper web sections or paper sheets (or signature sheets) provided as the top or as the bottom signature are printed with a stability-increasing coating (i.e. preferably in step (a) of the method according to the invention). In this way, the service life of the cover can be prolonged in an efficient and economical way. Clear lacquer has proven to be a particularly suitable material for this purpose, with which—in addition to the increase in stability—the value of the finished printed product can also be increased further by means of the more esthetic appearance.

In a further preferred embodiment of the present invention, either the top sheet of the top signature or else the bottom sheet of the bottom signature is formed with a length which is substantially longer by the thickness of the spine of the printed product than the length of the other signature sheets. In this way, in particular in the case of thicker printed products, it is possible to counter the circumstances in which, after the turning over, the content (i.e. the signatures or signature sheets of signature stack which do not form the cover) projects beyond the cover or the cover sheet; specifically by the thickness of the printed product which "is missing" from the cover sheet following the turning over.

In other words, the cutting of the paper web or else the supplying of the paper sheets must accordingly be carried out in such a way that the paper web section or the paper sheet which is intended to form the top or else the bottom signature is longer by the thickness of the product to be produced than the other paper web sections or paper sheets which form the content of the printed product. In practical terms, the bottom or the top sheet in the bottom or top signature (i.e. the cover sheet) then has an overhang X which compensates for the gap L which is produced.

In a further preferred embodiment of the present invention, the (cover) sheet folded open and provided with the adhesive layer is cut off at its free end along the adhesive layer. A preferred customary application arises when the cover sheet is cut off parallel to the spine (i.e. along the adhesive layer at its free end) before being turned over. In this way, a possible binding analogous to a binding by means of lining strips is obtained. The completed printing product can then be introduced, for example, as a (beneficial) pre-product into a hardcover cover (as a more expensive end product).

The present invention and preferred embodiments of the present invention are to be illustrated and explained by way of example in the following text, using the appended drawings, in which.

Figure 6A:
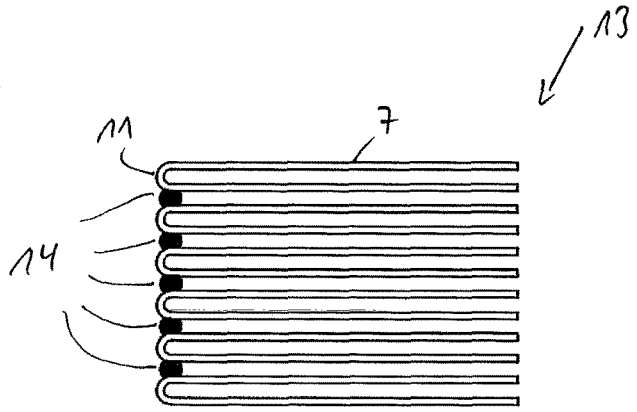
Figure 6B:
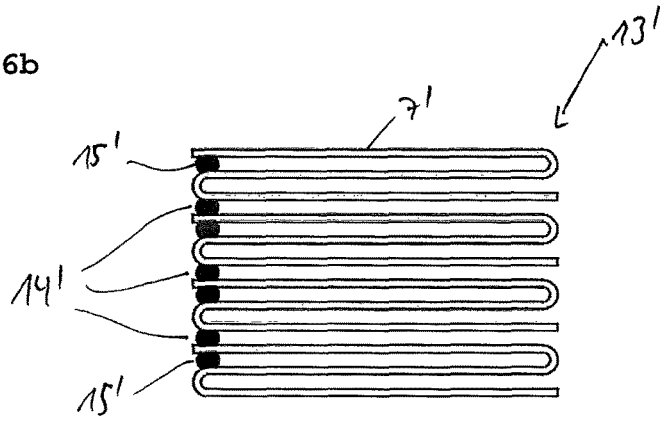
Figure 6C:
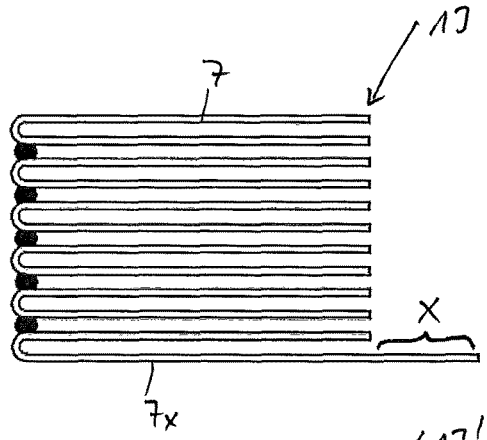
Figure 6D:
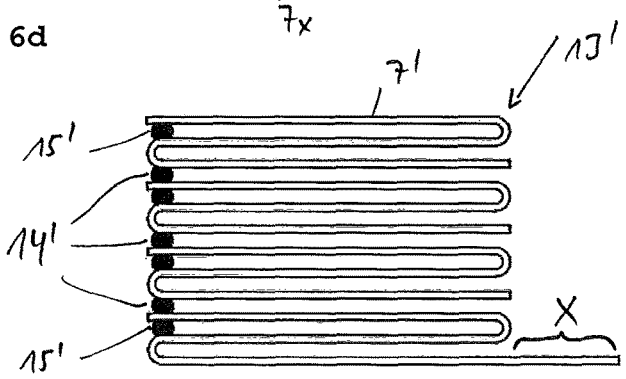
Figure 7A:
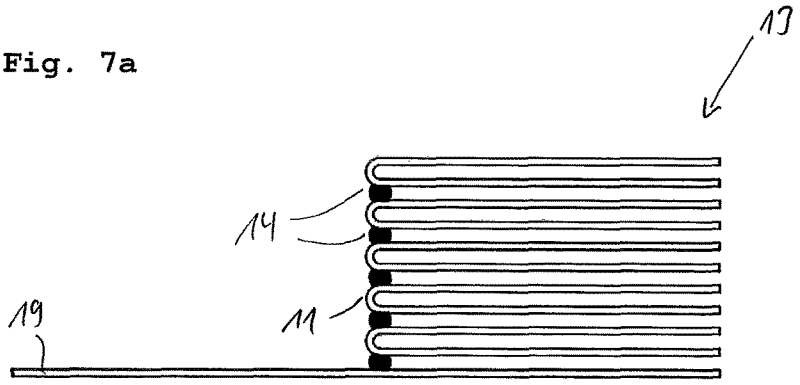
Figure 7B:
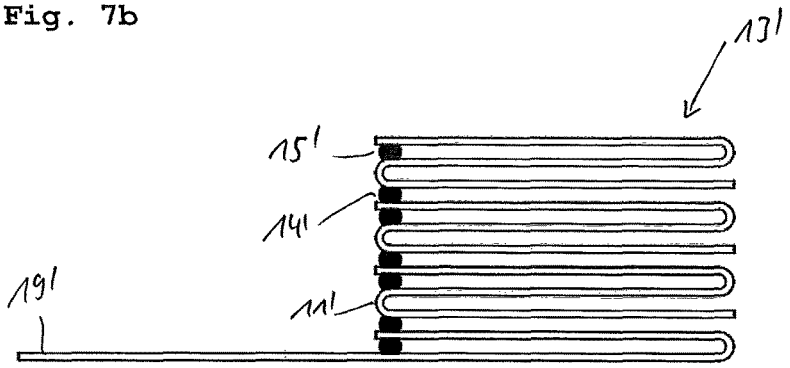
Figure 7C:
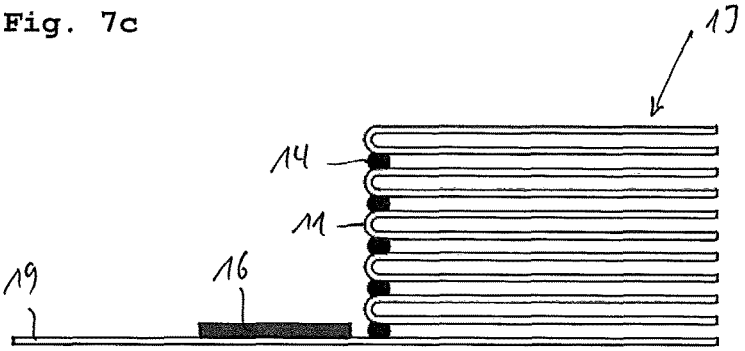
Figure 7D:
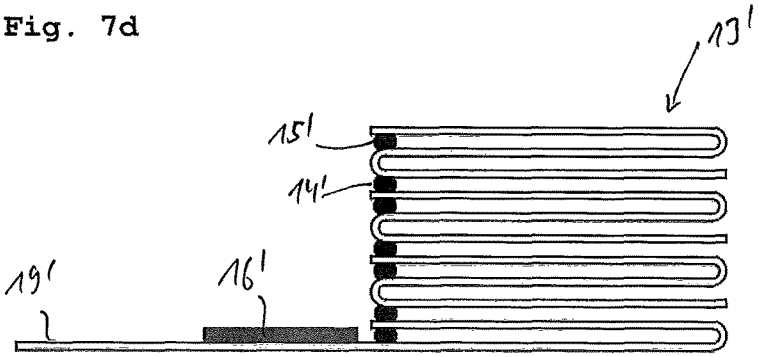
Figure 8A:
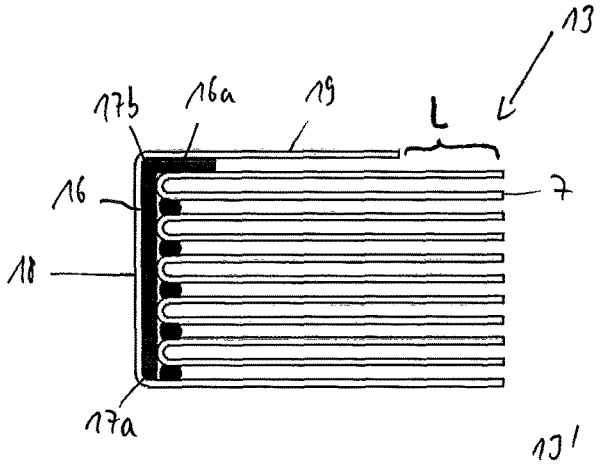
Figure 8B:
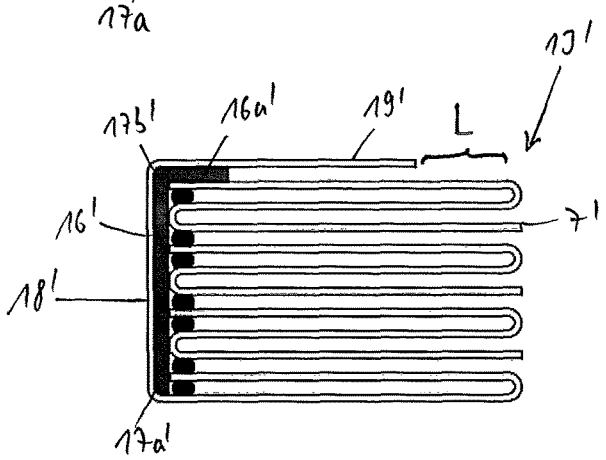
Figure 8C:
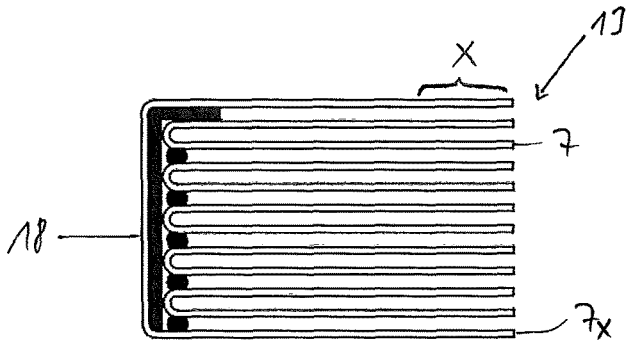
Figure 8D:
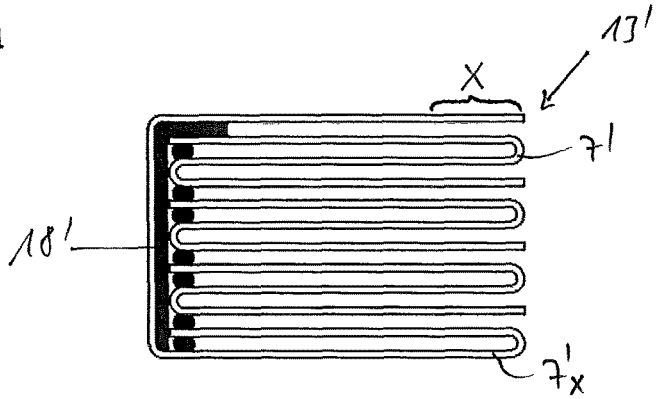
Figure 9A:
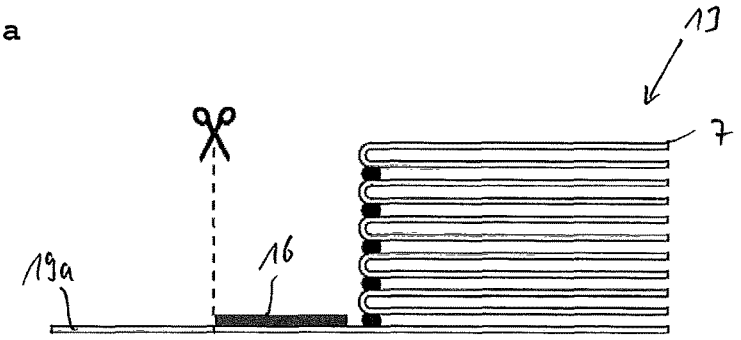
Figure 9B:
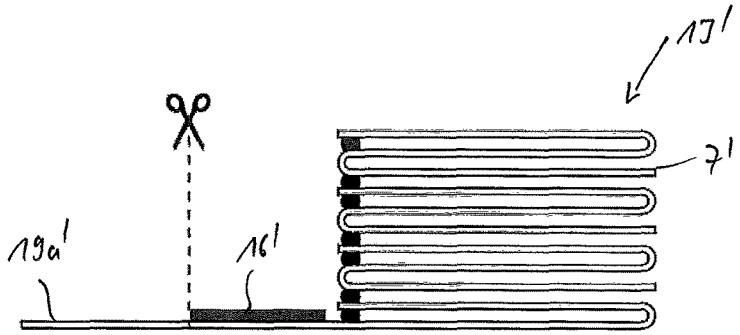
Figure 9C:
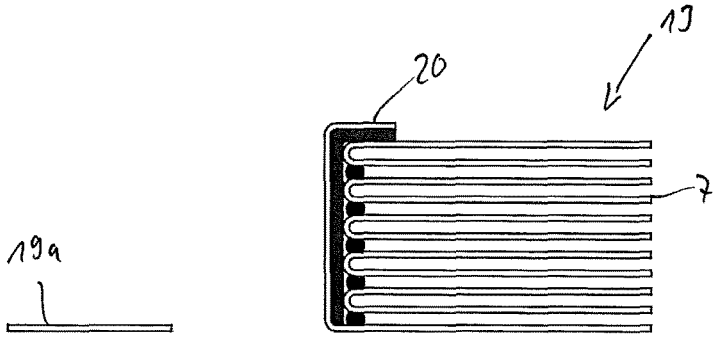
Figure 9D:
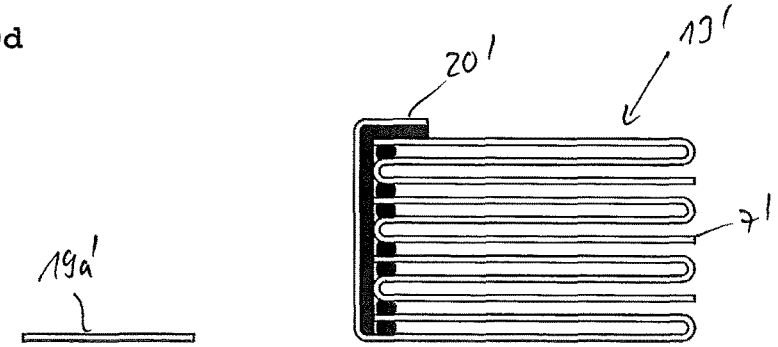
Figure 10A:
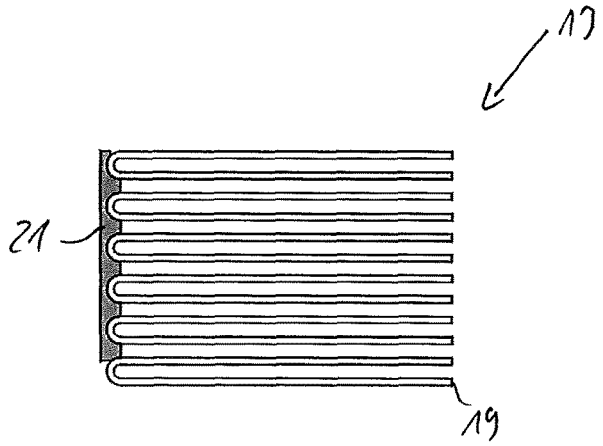
Figure 10B:
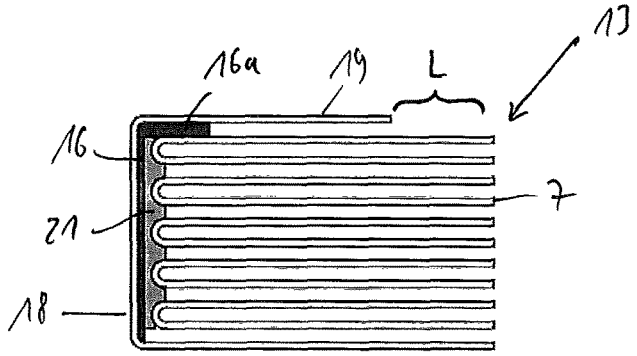
Figure 11:
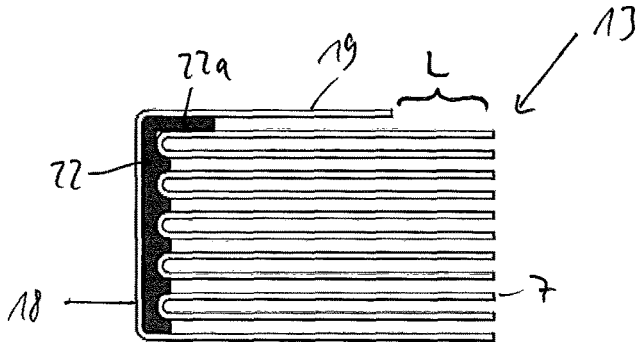
Figure 12:
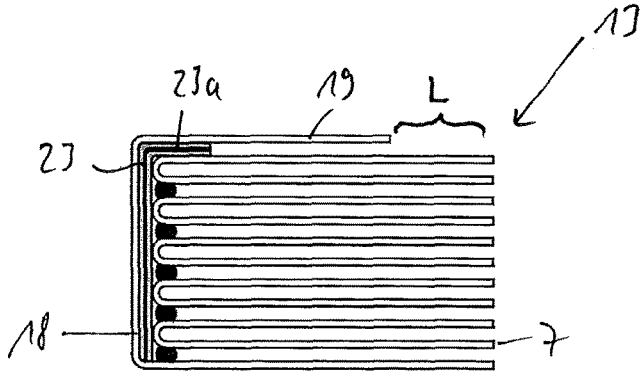
Figure 13:
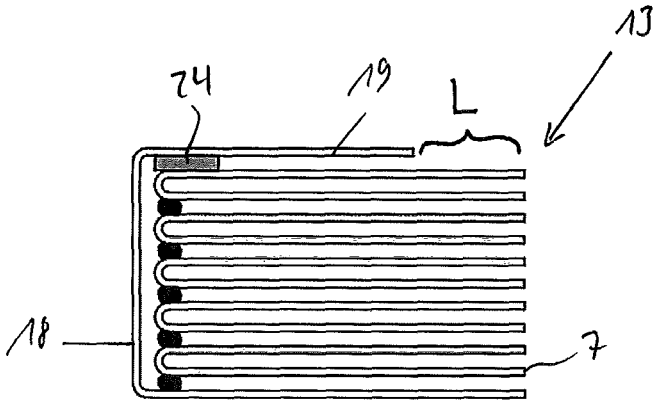
Figure 14:
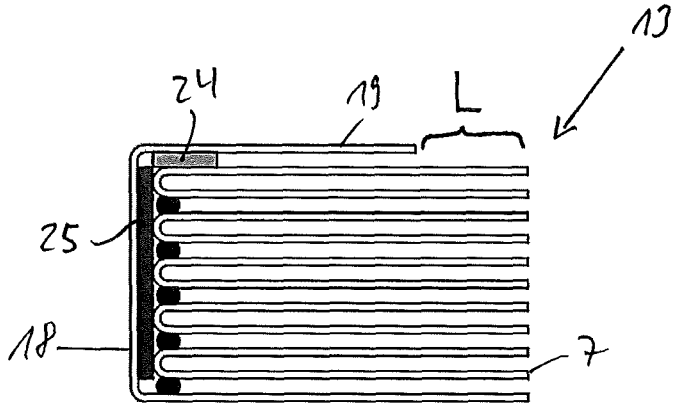

FIG. 6*a* shows a schematic illustration of a stack of signatures folded once and glued to one another;

FIG. 6*b* shows a schematic illustration of a stack of signatures folded twice and glued to and under one another;

FIG. 6*c* shows a schematic illustration of a stack of signatures folded once and glued to one another, the bottom signature having an overhang;

FIG. 6*d* shows a schematic illustration of a stack of signatures folded twice and glued to and under one another, wherein the bottom signature has an overhang;

FIG. 7*a* shows a schematic illustration of a stack of signatures folded once and glued to one another with the cover side folded open;

FIG. 7*b* shows a schematic illustration of a stack of signatures folded twice and glued to and under one another with the cover side folded open;

FIG. 7*c* shows a schematic illustration of a stack of signatures folded once and glued to one another with the cover side folded open and with an adhesive layer on the cover side;

FIG. 7*d* shows a schematic illustration of a stack of signatures folded twice and glued to and under one another with the cover side folded open and with an adhesive layer on the cover side;

FIG. 8*a* shows a schematic illustration of a stack according to FIG. 7*c* with the cover side turned over;

FIG. 8*b* shows a schematic illustration of a stack according to FIG. 7*d* with the cover side turned over;

FIG. 8*c* shows a schematic illustration of a stack according to FIG. 6*c* with an adhesive layer on said stack and the turned-over cover side;

FIG. 8*d* shows a schematic illustration of a stack according to FIG. 6*d* with an adhesive layer on said stack and the turned-over cover side;

FIG. 9*a* shows a schematic illustration of a stack according to FIG. 7*c* with the cover side folded open, the free end of which is cut off;

FIG. 9*b* shows a schematic illustration of a stack according to FIG. 7*d* with the cover side folded open, the free end of which is cut off;

FIG. 9*c* shows a schematic illustration of a stack according to FIG. 9*a* with the cover side turned over in the form of a lining;

FIG. 9*d* shows a schematic illustration of a stack according to FIG. 9*b* with the cover side turned over in the form of a lining;

FIG. 10*a* shows a schematic illustration of a stack of signatures folded once and pre-glued to one another in the spine area;

FIG. 10*b* shows a schematic illustration of a stack according to FIG. 10*a* with an adhesive layer on said stack and the turned-over cover side;

FIG. 11 shows a schematic illustration of a stack of signatures folded once and glued to one another in the spine area only by the adhesive layer on the cover side;

FIG. 12 shows a schematic illustration of a stack analogous to FIG. 8*a* with an adhesive tape as the adhesive layer on the cover side:

FIG. 13 shows a schematic illustration of a stack analogous to FIG. 7*c* but wherein the adhesive layer on the cover side is configured in such a way that, after being turned over, it provides only lateral gluing;

FIG. 14 shows a schematic illustration of a stack analogous to FIG. 7*c* but wherein two separate adhesive layers on the cover side are configured in such a way that, after being turned over, they provide both lateral gluing and also gluing in the spine area.

Figure 1:
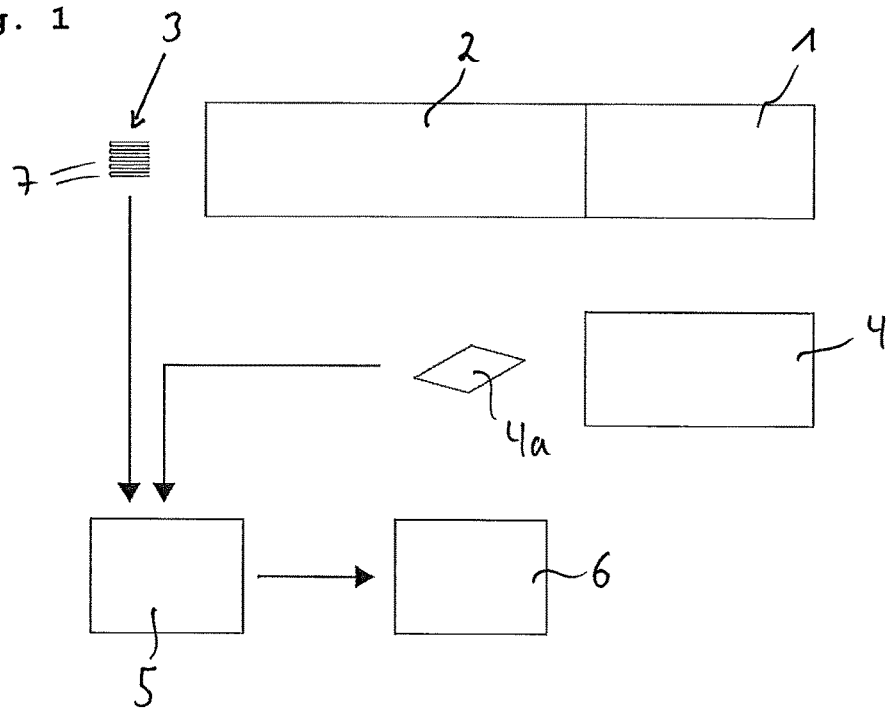
FIG. 1 shows a schematic illustration of a production line for printed products according to the prior art.

In FIG. 1, a production line for printed products or softcover books according to the prior art is illustrated.

In a printer 1, which may possibly be configured as a digital printer, first of all an appropriate paper web is printed. The paper web is then folded in a folding/cross-cutting module 2 and separated to form individual signatures 7. Instead of a combined folding/cross-cutting module 2, however, a separate folding module 2*a* and a separate cross-cutter 2*b* can also be used.

In a stacking station 3, the separated signatures 7 are then stacked on one another. At the same time or with a time offset, in an appropriate production module 4, the covers for the subsequent printed product or softcover book are printed and produced (i.e. typically as printed individual sheets).

The finished covers 4*a* are combined in a further step with the signature stacks (which are also designated as book blocks) from the stacking station 3. This is regularly done in a binding station 5. Following the binding station 5, the bound products are further fed to a trimming station, i.e. as a rule a three-side cutter 6.

Figure 2:
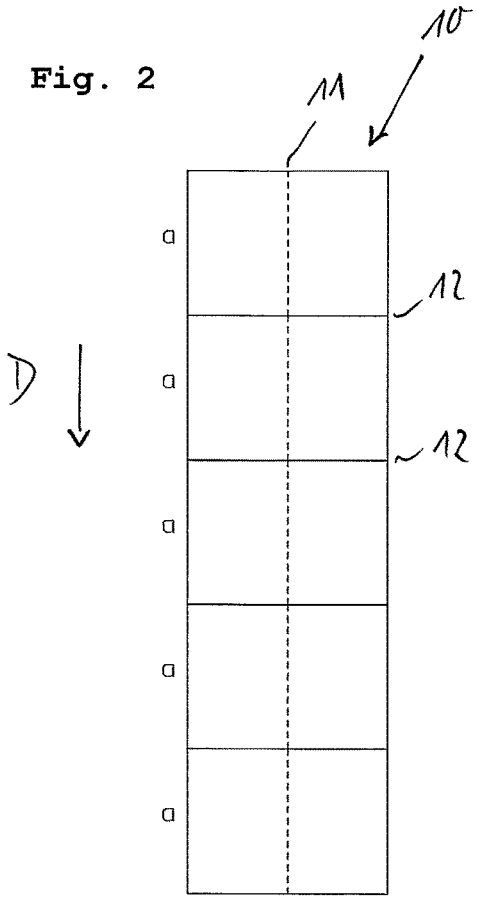
FIG. 2 shows a schematic illustration of a paper web cutout for signatures folded longitudinally once (printing direction from top to bottom)

FIG. 2 illustrates an extract from a printed paper web 10 with printing direction D from top to bottom. The appropriately printed signature sheets a are folded once in the longitudinal direction, i.e. about the line 11, and then cross-cut along the lines 12 (i.e. here, the cutting is carried out after the folding) and are then stacked. Signatures produced in this way are in principle known from the prior art indicated above; however, they are also used in conjunction with the method according to the invention.

Figure 3:
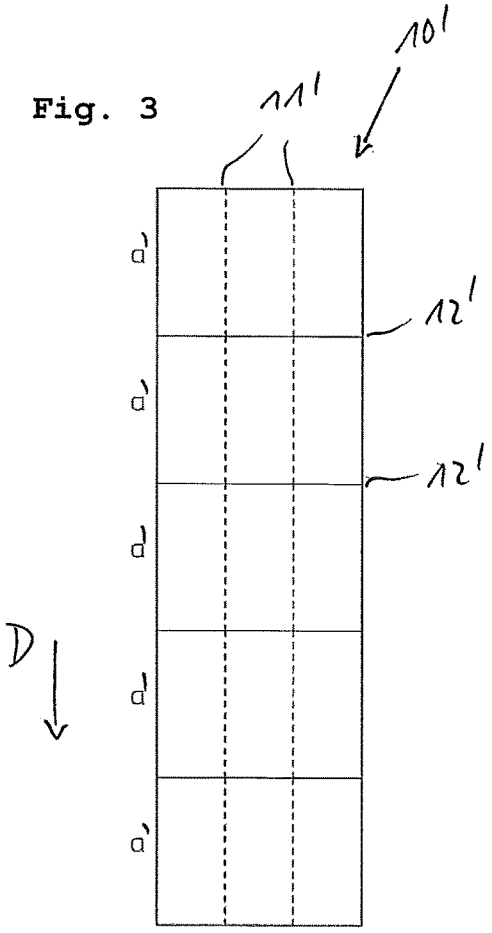
FIG. 3 shows a schematic illustration of a paper web cutout for signatures folded longitudinally twice (printing direction from top to bottom.

In FIG. 3, an extract from a printed paper web 10' is illustrated, with printing direction D once more from top to bottom. In this case, signature sheets a' are provided which are folded twice in the longitudinal direction, that is to say about the lines 11', and then cross-cut along the lines 12' (i.e. here the cutting is carried out after the folding) and finally are stacked on top of one another. Individual sections of the signature sheets a' can also be glued to one another during the folding (i.e. to one free end of the signature sheet a', for example, in the area of one of the folding lines 11'). Signatures produced in this way are likewise known in principle from the prior art indicated above; however, they are also used in conjunction with the method according to the invention.

Figure 4:
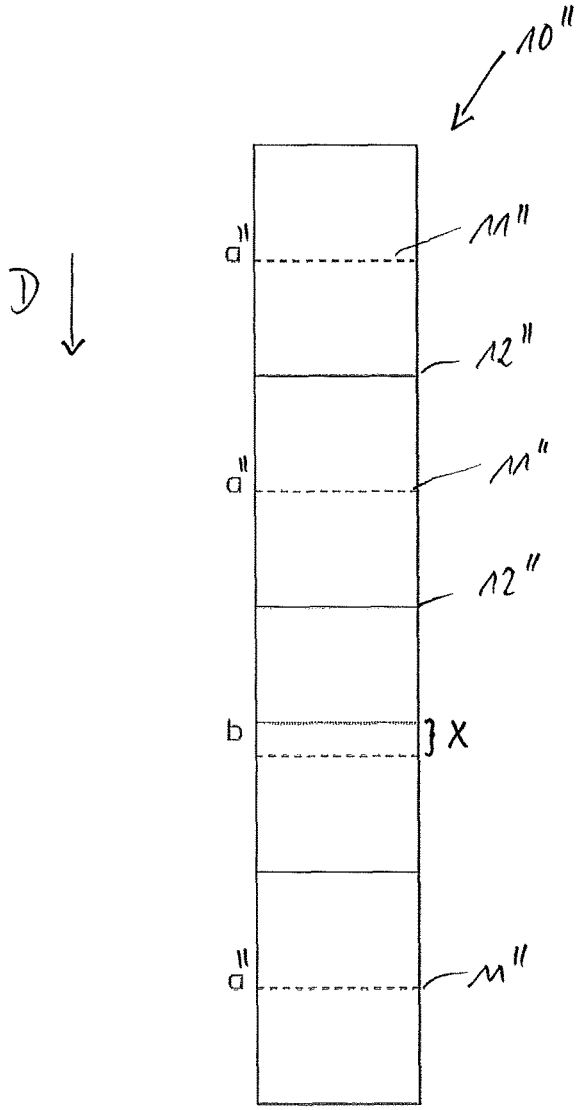
FIG. 4 shows a schematic illustration of a paper web cutout for signatures folded transversely once (printing direction from top to bottom)

In FIG. 4, a further example of an extract from a printed paper web 10" is shown, with printing direction D once more from top to bottom. Here, signature sheets a", b are provided, which are cross-cut in the transverse direction along the lines 12" and then cross-folded along the lines 11" (i.e. here the cutting is carried out before the folding) and then stacked on one another. As compared with the signature sheets a", the signature sheets b have an overhang X which, as they are subsequently turned over around a signature stack or book block, compensates approximately for the thickness of the spine of the later printed product (or the gap L produced as a result, see, for example, FIGS. 8*a* and 8*b* below).

Figure 5:
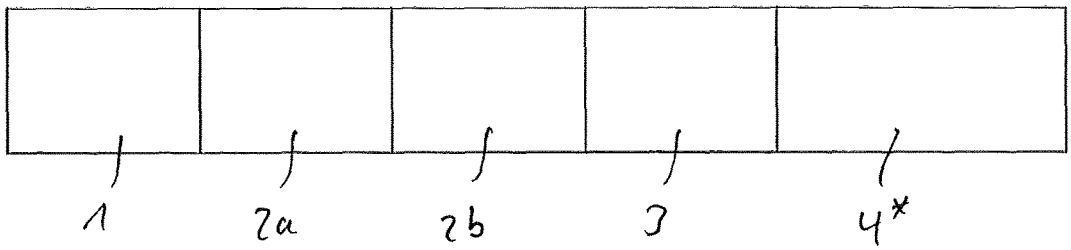
FIG. 5 shows a schematic illustration of a production line for implementing the method according to the invention.

FIG. 5 now comprises a schematic illustration of a production line for printed products or softcover books according to the method according to the invention. The individual process steps can be carried out directly one after another, i.e. in-line, but in principle, as mentioned, there is also the possibility of executing individual process steps off-line.

The fundamental process sequence is as follows: firstly, in a printer 1, preferably a digital printer, the paper web is printed. Following this, the paper web is folded in a folding module 2*a*. This is followed in a cutting module by the cross-cutting 2*b* of the paper web, the individual signatures being produced (i.e. except in the case of FIG. 4, where cutting is carried out first and then folding). Then, the cut signatures are stacked on one another in a stacking station 3. The production of the cover (i.e. turning over the top or bottom signature around the respective signature stack or book block) is then carried out in accordance with the inventive method in a special production module 4*.

In the following text, preferred exemplary embodiments of the present invention will now be explained in detail:

In FIG. 6*a*, firstly, a stack 13 of signatures 7 folded once and glued to one another is shown. The signatures 7 have been produced, for example, from a paper web 10 according to FIG. 2. As the individual signatures 7 are stacked on one another, an adhesive application 14 was respectively applied to the upper side or underside of the next following signature 7, in order to ensure stable cohesion of the stack 13. The adhesive application 14 is regularly carried out in the immediate vicinity of the stack spine or the folding lines 11 (but not in the stack spine itself).

In FIG. 6*b*, a stack 13' of signatures 7' folded twice and glued to one another and under one another is then illustrated, having been produced, for example, from a paper web according to FIG. 3. Once more, an adhesive application 14' is applied to the upper side and underside between the individual signatures 7' stacked on one another, once more in each case in the vicinity of the stack spine or in the vicinity of the folding lines 11' placed in the spine (but not in the stack spine itself).

In addition here, however, gluing of the respectively uppermost signature sheet with the second uppermost signature sheet (i.e. within a signature 7') is also provided, specifically by means of an application 15' of glue, which once more, in a manner analogous to the adhesive application 14, has been applied in the vicinity of the stack spine or in the vicinity of the folding lines 11' placed to form the spine (i.e. the additional gluing is carried out approximately during the folding in a manner analogous to FIG. 3). In this way, particularly good stability of the stack 13' is ensured, although this procedure is somewhat more complicated than that previously described.

FIGS. 6*c* and 6*d* correspond to the above-described FIGS. 6*a* and 6*b*, with the difference that the respective bottom signature $7_x$ or $7'_x$ has an overhang X with respect to the remaining signatures 7 or 7' of the stack 13 or 13'. The signature having the overhang $7_x$ or $7'_x$ can be produced approximately in accordance with the paper web according to FIG. 4, but in principle it is also conceivable, in a modified method, that the lengthened signature sheet is produced from paper webs folded longitudinally. The overhang X over the remaining signatures 7 or 7' is intended to compensate approximately for the thickness of the spine later, i.e. after being turned over.

In FIGS. 7*a* and 7*b*, the next process step of the method according to the invention is now illustrated as compared with the above FIGS. 6*a* and 6*b*. As can be seen, in the signature stacks 13 and 13' the cover sheet 19 or 19' of the respective bottom signature 7 or 7' is folded open in each case, so that it is then located approximately at right angles to the spine of the stack 13 or 13'.

In a further process step, which is respectively illustrated by using FIG. 7*c* and FIG. 7*d*, an adhesive layer 16 or 16' is then applied to the inner side of the folded-open cover sheet 19 or 19'. The length of the adhesive layer 16 or 16' and the thickness of the spine of the stack 13 or 13' are otherwise not to be viewed as being to scale in the present case (this applies in principle to all the figures).

In FIGS. 8*a* and 8*b*, it is now illustrated, as the next process step of the method according to the invention, how in each case the folded-open cover sheet 19 or 19' having the adhesive layer 16 or 16' is turned over (around) the stack 13 or 13', to be specific firstly approximately around the bottom adhesive application 14 or 15' and then around the top signature 7 or 7' or else the top adhesive application 14 or 15'.

During this turning operation, a first turned-over edge 17*a* and a second turned-over edge 17*b* are correspondingly formed, between which the spine 18 or 18' of the printed product is formed. The adhesive layer 16 or 16' extends over the entire thickness of the spine 18 or 18' and also preferably forms a (smaller) lateral section 16*a* or 16*a'*, in order to be able to ensure optimal stability of the printed product.

Since, in these exemplary embodiments, the bottom signature 7 or 7' has no overhang with respect to the other signatures in each case, because of the thickness of the spine 18, 18' a gap L with respect to the remaining signatures 7 or 7' of the stack 13 or 13' is formed. In the case of disposable products to be produced beneficially, this is tolerable, since the beneficial production more than outweighs the visual impairment which occurs at best (i.e. only in the case of relatively thick printed products).

However, as illustrated in FIGS. 8*c* and 8*d*, this deficiency can be eliminated in that the bottom signature 7 or 7' used in each case is a signature $7_x$ or $7'_x$, which has an appropriate overhang X with which the gap L can, so to speak, be closed.

The printed products are regularly also pressed in a final process step, in particular to press the cover onto the content and thus to increase the composite stability overall (this applies of course to all the embodiments shown).

A further embodiment of the method according to the invention is illustrated in FIGS. 9*a* to *d*. As compared with FIG. 7*c* or 7*d*, here in each case the free end 19*a* or 19*a'* of the cover sheet 19 or 19' is severed or cut off along the end of the adhesive layer 16 or 16' pointing away from the stack 13 or 13'. Then, the cover sheet 19 or 19' shortened in this way is turned over around the stack 13 or 13' (i.e. in principle in a way analogous to FIGS. 8*a* to *d*) and a shortened cover is produced on the upper side of the stack 13 or 13' and is designated as a wrap or lining 20 or 20'.

In this way, within the context of the present invention, a pre-product for a more expensive end product is formed, wherein approximately the entire printed product can be, for example, inserted into a hard cover and joined to the latter via the lining 20 or 20' (or the wrap).

In FIGS. 10*a* and 10*b*, a further variant of the method according to the invention is illustrated. Here, the individual signatures 7 of the signature stack 13 are not glued to one another in their upper side or underside, instead a (common) adhesive application 21 is applied along the stack spine, which preferably also penetrates somewhat into the interspaces between the individual signatures in the spine area. The application of this adhesive application 21 is generally carried out by using appropriate rollers of a specific application device, specifically in the form of parallel stripes or else over the complete area along the spine.

The gluing thus achieved is possibly somewhat more flexible than, for example, in the stack according to FIG. 6*a* (which may be desired, depending on application), furthermore the adhesive application can be carried out more quickly over time and more economically. The further method sequence then corresponds to FIGS. 7*a*, 7*c* and 8*a*, i.e. an adhesive layer 16 is applied to the folded-open cover sheet 19 and, after being turned over, covers the spine of the stack 13 and a smaller lateral area 16*a*. In this exemplary embodiment, too, a gap L relative to the remaining signatures 7 of the stack 13 remains, although this can in turn be avoided by the use of a signature $7_x$ having an overhang X. In principle, this solution is also applicable to stacks 13', for example according to FIG. 6*b*.

A further exemplary embodiment of the present invention is illustrated in FIG. 11. Here, a stack 13 of signatures 7, which have not been glued to one another (a so-called loose sheet stack), is held together merely by means of the adhesive layer 22 of the cover sheet 19. The adhesive layer 22 in principle corresponds to the adhesive layer 16 known from the previous examples; however it is preferably implemented somewhat more thickly than in those previous examples.

As the cover sheet 19 is turned over, the adhesive layer 22 is used for the (sole) gluing of the signatures 7 of the stack 13. As it is turned over, it is preferably also forced into the interspaces between the individual signatures in the spine area of the stack, in order to create a stable composite. Furthermore, the adhesive layer 22 also comprises a lateral area 22*a*.

Here, once more, a gap L with respect to the remaining signatures 7 of the stack 13 is produced, although, as before, it can be compensated by the use of a bottom signature $7_x$ with an overhang X.

In FIG. 12, a still further embodiment of the method according to the invention is shown. The starting point here is a stack 13 with signatures 7 folded once and glued to one another in the area of the upper side and underside (i.e. approximately according to FIG. 6*a*), wherein, however, the adhesive layer 16 is now formed (i.e. approximately according to FIG. 7*c*) by a (prefabricated) double-sided adhesive tape 23. The (bottom) signature 7 that is turned over is therefore glued to the stack 13 by means of the double-sided adhesive tape. The double-sided adhesive tape 23 also comprises a lateral area 23*a*.

In this way, particular strengthening of the spine 18 can be achieved. Here, too, once more the gap L can be compensated by the use of a bottom signature $7_x$ having an overhang X. In principle, this variant can also be used in conjunction with stacks 13' according to FIGS. 6*b* and 7*b*, for example.

A further variant of the method according to the invention is illustrated in FIG. 13. The starting point is once more a stack 13 having signatures 7 folded once and glued to one another, wherein, however, after the bottom signature 7 has been turned over, only a (relatively narrow) adhesive layer 24 for the side area of the stack 13 is applied to the inner side of the cover sheet 19, corresponding approximately to the lateral area 16*a* of the adhesive layer 16 according to FIG. 8*a*.

In other words, the signature 7 that is turned over or the cover sheet 19 that is turned over is glued only in the side area of the printed product or softcover book but not in the spine of same. In this way, in particular, damage to the spine during opening of the finished printed product or the book can be avoided, in any case can be reduced. Each adhesive layer 24 can also be configured as (prefabricated) double-sided adhesive tape.

Here, too, the gap L can be compensated by the use of a signature $\mathbf{7}_x$ having an overhang X. Furthermore, this variant can in principle also be used in conjunction with a signature stack 13' according to FIG. 6*b* or FIG. 7*b*, for example.

In a yet further embodiment of the method according to the invention according to FIG. 14, the inner side of the cover sheet 19 of the bottom signature 7 is provided with respectively different adhesive layers 24 and 25 (i.e. preferably adhesive layers produced from different adhesives) for the spine area and side area of the printed product. The two adhesive layers 24 and 25 are preferably applied separately from each other, i.e. they do not regularly form a continuous or merging adhesive layer. The adhesive layers 24 and 25 can also each be configured as (prefabricated) double-sided adhesive tapes.

In this way, stronger gluing (e.g. by the use of a somewhat thicker adhesive layer and/or a stronger adhesive) can be achieved in the side area of the printed product and, in the spine area 18, a higher elasticity can be provided for this purpose (e.g. by means of the use of a somewhat thinner adhesive layer and/or a less strong or more flexible adhesive).

Here, too, once more the gap L can be compensated by the use of a signature $\mathbf{7}_x$ having an overhang X. Furthermore, this variant can in principle also be used in conjunction with a signature stack 13' according to FIG. 6*b* or FIG. 7*b*, for example.

LIST OF DESIGNATIONS

1 Printer
2 Folding/cross-cutting module
2*a* Folding module
2*b* Cross-cutting module
3 Stacker or stacking station
4 Cover production (prior art)
4*a* Cover (prior art)
4* Cover production (according to the invention)
5 Combining or binding station
6 Three-side cutter
7 Signature (folded once)
7' Signature (folded twice)
$\mathbf{7}_x$ Signature (folded once) with overhang
$\mathbf{7'}_x$ Signature (folded twice) with overhang
10 Paper web (folding once in longitudinal direction)
10' Paper web (folding twice in longitudinal direction)
11 Folding line
11' Folding lines
12 Cutting lines
12' Cutting lines
13 Stack
13' Stack
14 Adhesive application (between two signatures a)
14' Adhesive application (between two signatures a')
15' Adhesive application (within a signature a')
16 Adhesive layer (on the cover sheet 19)
16' Adhesive layer (on the cover sheet 19')
16*a* Lateral area of adhesive layer
16*a'* Lateral area of adhesive layer
17*a* First turned-over edge
17*b* Second turned-over edge
18 Spine
18' Spine
19 Folded-open cover sheet (signature 7)
19' Folded-open cover sheet (signature 7')
19*a* Cut-off free end of cover sheet
19*a'* Cut-off free end of cover sheet
20 Lining
20' Lining
21 Adhesive application in the spine
22 Adhesive layer for loose sheet stack
22*a* Lateral area of adhesive layer
23 Adhesive tape
23*a* Lateral area of adhesive tape
24 (Separate) lateral adhesive application
25 (Separate) adhesive application for stack spine
a Signature sheet (folded longitudinally once)
a' Signature sheet (folded longitudinally twice)
a" Signature (cross-folded once)
b Signature sheet with overhang (cross-folded once)
D Printing direction
L Gap after turning over
L' Gap after turning over
X Overhang of signature $\mathbf{7}_x$
X' Overhang of signature $\mathbf{7}_x'$

The invention claimed is:

1. A method for producing printed products, in particular softcover books, with integrated cover, wherein the method comprises at least the following steps:

(a) printing of a paper web or individually supplied paper sheets, preferably by means of digital printing;
(b) optional application of an adhesive to the paper web or the paper sheets;
(c) single or multiple folding and cutting of the paper web to form signatures or else single or multiple folding of the paper sheets to form signatures;
(d) optional application of an adhesive to the signatures signatures;
(e) stacking of the signatures to form a signature stack with at least one top and one bottom signature;
(f) folding open the top sheet of the top signature or else the bottom sheet of the bottom signature and applying an adhesive layer in at least the area of the folded-open sheet, which is intended to comprise at least the spine and/or an area of the signature stack adjacent to the spine;
(g) turning over the sheet folded open and provided with the adhesive layer around the spine of the signature stack, so that the cover for the printed product is formed; and
(h) optional pressing of the cover.

2. The method as claimed in claim 1, wherein, before or during the stacking of the signatures, an adhesive is applied to the upper side and/or underside of the individual signatures.

3. The method as claimed in claim 1, wherein, after the stacking of the signatures, an adhesive is applied in the spine area of the signature stack.

4. The method as claimed in claim 1, wherein the adhesive layer is configured in the form of an adhesive application or else in the form of a double-sided adhesive tape.

5. The method as claimed in claim 1, wherein the adhesive applications are formed from cold adhesives, hot adhesives or from a combination of cold and hot adhesives.

6. The method as claimed in claim 1, wherein one or more grooves are introduced into the paper web sections or paper sheets provided as the top or the bottom signature.

7. The method as claimed in claim 1, wherein the paper web sections or paper sheets provided as the top or as the bottom signature are printed with a stability-increasing coating.

8. The method as claimed in claim 1, wherein the cutting according to step (c) is carried out before or after the folding.

9. The method as claimed in claim 1, wherein either the top sheet of the top signature or else the bottom sheet of the bottom signature is formed with a length, which is substantially longer by the thickness of the spine of the printed product than the length of the other signature sheets.

10. The method as claimed in claim 1, wherein the folded-open sheet provided with the adhesive layer is cut off at its free end along the adhesive layer.

11. A printed product, in particular a softcover book, produced by the method as claimed in claim 1.

* * * * *